United States Patent [19]

Haug et al.

[11] 4,078,161

[45] Mar. 7, 1978

[54] IGNITION DISTRIBUTOR BREAKER ASSEMBLY

[75] Inventors: Heinz Haug, Munchingen; Günter Käs, Stuttgart, both of Germany

[73] Assignee: Robert Bosch GmbH, Stuttgart, Germany

[21] Appl. No.: 716,022

[22] Filed: Aug. 19, 1976

[30] Foreign Application Priority Data

Sep. 16, 1975 Germany ..... 2541164

[51] Int. Cl.[2] ..... H01H 19/00; F02P 7/00

[52] U.S. Cl. ..... 200/19 R; 200/31 V

[58] Field of Search ..... 200/31 R, 11 J, 31 A, 200/31 C, 31 DP, 31 V, 19 R, 19 A; 123/146.5 R, 146.5 A

[56] References Cited

U.S. PATENT DOCUMENTS

| | | | |
|---|---|---|---|
| 1,886,566 | 11/1932 | Mallory | 200/31 V X |
| 3,501,601 | 3/1970 | Cooksey | 200/31 V |
| 3,688,391 | 9/1972 | Cooksey | 200/19 R X |
| 3,983,352 | 9/1976 | Ellis, Jr. et al. | 200/11 J |

FOREIGN PATENT DOCUMENTS

| | | | |
|---|---|---|---|
| 2,135,315 | 1/1972 | Germany | 123/146.5 A |

*Primary Examiner*—James R. Scott
*Attorney, Agent, or Firm*—Flynn & Frishauf

[57] ABSTRACT

To securely hold the distributor shaft of a distributor-breaker combination, while permitting relative rotation of the breaker contact carrier plate with respect to a main support plate, a bearing sleeve of elastic material, preferably a thermoplastic, is fitted into both plates, with axial loading, for example by a bowed sheet metal spring, and holding projections to hold the plates together, the bearing sleeve being slotted axially to provide for movable, rotatable connection of the breaker support plate without play in radial as well as in axial direction and permit rapid assembly under production conditions.

13 Claims, 2 Drawing Figures

IGNITION DISTRIBUTOR BREAKER ASSEMBLY

FIELD OF THE INVENTION

The present invention relates to a combined ignition distributor-breaker assembly, and more particularly to a structure to connect the breaker contact support plate to the main carrier plate of the ignition distributor in a way which permits rotary movement of the breaker contact support plate with respect to the carrier plate to adjust the timing of the ignition instant by linking the breaker support to a vacuum diaphragm chamber, or the like.

BACKGROUND AND PRIOR ART

It is necessary to adjust the operation of the breaker contacts with respect to the axial position of the distributor cam shaft to adjust the ignition timing. The adjustment parameter is usually provided by sensing the static vacuum in the carburetor or inlet manifold of the internal combustion engine. This vacuum is dependent on the instantaneous position of the throttle. It is highest at about half throttle opening. The breaker contact support plate is linked by means of a rod to a spring-loaded membrane of a diaphragm chamber in such a manner that, upon change in the vacuum, the breaker support plate rocks coaxially with respect to the distributor shaft about a small angle so as to vary the relative position of the breaker contact with respect to the land of the cam shaft of the distributor.

Movement of the breaker support plate should be free, so that the contacts located thereon can operate in accordance with commanded timing; for free operation, it is important that the breaker support plate is secured by a bearing which permits twisting or rotory motion without, however, introducing or permitting play in radial or axial direction.

It has previously been proposed to construct a breaker timing adjustment arrangement by securing an extended bearing to the main support plate of the distributor and forming a collar or flange on the breaker support plate, the telescoped connection of elements forming the bearing. Radial play of the bearing is then determined by manufacturing tolerances. To eliminate play, a ball is pressed against the breaker support plate by a bail-shaped holder formed as a spring. The ball eliminates axial play without interfering with rocking movement of the breaker support plate about the axis of rotation of the distributor cam. This arrangement satisfies the requirements of eliminating axial and radial play; it is, however, important that the tolerances in manufacture are small. The manufacture of the parts is usually effected by drawing. The bail-shaped spring and the ball, which bears against a location on the breaker support plate which is relieved to seat the ball, require additional assembly and manufacturing steps which increase the cost of the final article — a cost which should preferably be avoided.

It has also been proposed to eliminate axial play when inserting a breaker contact support plate into an elongated bearing by providing an axially acting spring secured to a ring. This still requires an accurate elongated sleeve bearing and a ring of accurate size, all parts which have to be accurately made and accurately mounted in order to ensure reliable, troublefree operation. Incorrect mounting, excessive tolerances or careless assembly lead to malfunction.

SUMMARY OF THE INVENTION

It is an object of the present invention to provide a bearing structure for the breaker support plate in ignition distributor-breaker assemblies which is simple to make, sturdy, reliable, and which permits use of manufacturing steps not requiring high degrees of accuracy, while permitting assembly without excessively careful attention to detail.

Briefly, a bearing sleeve of elastic material, preferably a thermoplastic and made by an injection process, is fitted coaxially with the axis of the distributor shaft into openings formed in the main carrier plate for the breaker assembly, as well as in the contact support plate. The sleeve is formed with means to hold the distributor breaker plate without play while still forming a bearing therefor, including preferably a bowed leaf-spring bearing axially between a flange of the sleeve and the carrier plate, the sleeve being held in position against the contact support plate by projections overlapping the upper surface of the support plate.

DESCRIPTION OF THE PREFERRED EMBODIMENT

Figure 1:
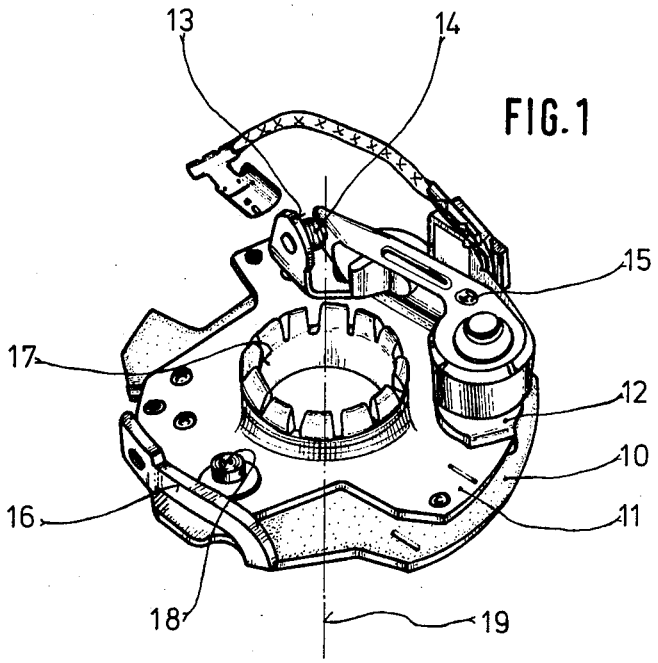
FIG. 1 is a perspective illustration of the breaker support plate located on the carrier plate, and showing the general arrangement.

A fixed carrier plate 10 is secured to the housing of the distributor-breaker assembly (not shown). The carrier plate 10 is formed with one or more upstanding lugs 16 to attach the carrier plate in the housing. A breaker contact support plate 11, to which a breaker contact assembly 12 is secured, is located coaxially with the shaft opening for the distributor-breaker cam shaft, for rocking rotory movement about the axis 19 of the distributor shaft. The breaker switch arm 15 cooperates with a fixed breaker contact 13. The breaker support plate 11 is connected for rocking movement about axis 19 with the carrier plate 10 by a bearing sleeve 17. A vacuum diaphragm chamber (not shown) controlling ignition timing can be connected to a pin 18 projecting from the breaker contact support plate 11. Upon engagement of a link from the vacuum diaphragm chamber, plate 11 can rock about axis 19 with respect to the plate 10 through a small angular excursion.

The carrier plate 10 is formed with a central bore 21. The breaker contact support plate 11 has an upstanding collar 22 which, at the upper part, has a conically divergent portion 23 extending towards the upper edge 24 of collar 22. One or more slide projections 25, for example essentially hemispherically shaped, provide bearing surfaces between the carrier plate 10 and the breaker support plate 11.

Sleeve 17 is made of an elastic material, preferably a thermoplastic resin. It can be made by an injection process, thus providing elements of accurate size, at minimum cost. Sleeve 17, essentially, has a sleeve-like hub portion 26 which is formed with a flange 27. The upstanding hub portion 26 is subdivided by axial slits 29, leaving upstanding tongues 28 therebetween. Each one of the tongues 28, at its upper, free end, merges into a snap-over projection 31. The upper surfaces of the tongues 28 are chamfered, as seen at 31. The outer wall 32 of the sleeve 17 has a conically divergent surface matching the conical surface 23, so that the fitting, engaging surfaces of the sleeve 17 and of the collar 22 will coincide.

Figure 2:
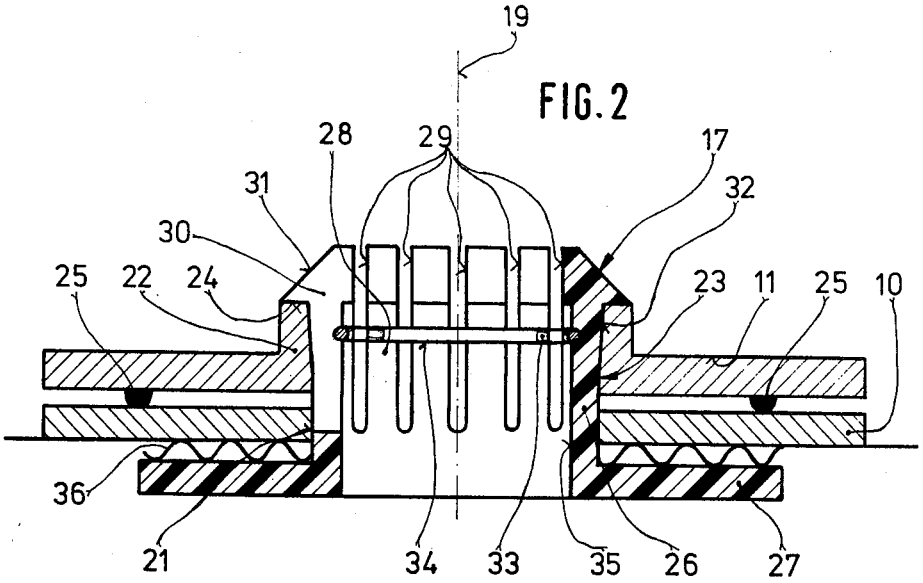
FIG. 2 is a longitudinal, axial sectional view through the assembly illustrated in FIG. 1.

A spring ring 33 is inserted into a groove 34 formed in the tongues. The spring ring 33 is located above the main plane of the plate 11 but within the range of collar 22. It provides a radially outwardly directed resilient force to hold the tongues 28 spread in overlapped condition, as shown in FIGS. 1 and 2. Ring 33, as well as groove 34, may not be necessary for all applications.

The parts are held in axially biassed engagement by a bowed leaf spring 36 providing a resilient axial force between plates 10, 11. Leaf spring 36 is located between the flange 27 formed on the sleeve 17 and the bottom surface of plate 10.

Assembly and operation: Spring element 36, with a central opening, is slipped over sleeve 17. The assembly of spring 36 and sleeve 17 is pushed upwardly (FIG. 2) in bore 21 and thereafter in the conically divergent portion 23. Projections 30 thus can pass through the openings 21, 23 until the projections 30 snap over the upper edge 24 of the collar 22 of plate 11 into the position shown in the Figures. To secure them in position, if desired, the axially outwardly directed ring 33 is snapped into the groove 34, providing permanent reliable seating of the tongues 28 on the collar 22.

The two plates 10, 11 can be axially fixed in position also without the spring element 36. Axial play is, however, reliably avoided by providing a spring element as shown, even under unfavorable operating conditions. The radially outwardly directed spread of the tongues 28 over the dilating conical surface 23 provides reliable elimination of any radial play. This radial play is eliminated by the spring ring 33, as well as by the spring element 36 which, in combination with the conical surfaces 23, tends to amplify tendencies to eliminate radial play.

The structure uses the property of artificial resins, particularly their elasticitiy, in order to provide a reliable and simple bearing arrangement using only a single element therefor. The arrangement has the advantage that the contact support plate as well as the main carrier plate require only a single opening which can be made by a punching operation - a manufacturing step which permits high accuracy at substantially lower costs than combined punching-and-drawing operations. The bearing sleeve takes the function of an extended sleeve bearing with respect to the plates; thus, coarse tolerances can be used in manufacture of the bores of the plates. The bearing sleeve 17 can be made accurately and easily with comparatively cheap injection molds while providing a low-friction bearing highly effective in counteracting tendency to tilt or to bind by axial tipping.

The sleeve is readily assembled since the flange 27, with spring 36 interposed, fits against the lower surface of plate 10 whereas the overlapping projections 30, after inward deflection in the bore, will reliably, resiliently snap in the position shown in the drawings. Thus, and after the projections have snapped into the position shown, the two plates are effectively and permanently attached together. The formation of the tongues 28 by the interposed slits 29 increases the radially directed elasticity and thus the engagement of the sleeve 17 with the plate 11. The radially outwardly directed resilient force exerted by ring 33 in groove 34 increases reliability of attachment and provides for effective spreading action of the tongues 28 even under unfavorable operating conditions. The flange 27 as well as each one of the projections 30 will overlap, or engage, respectively, the respective plates. The conical surface 23 has the additional advantage that, under extremes of temperature, or after wear of the movable part, any play in the bearing is still eliminated.

The basic advantage of the structure is its simplicity; rather than using a plurality of elements and components made of steel, which must be matched to each other and thus made with accuracy and with low tolerances, a central plastic, preferably injection molding part is used which, by concentric force distribution, additionally provides increased reliability with respect to resistance to tilt while requiring only low axial holding force. Assembly of the sleeve to the plates is rapid and can be carried out without special tools or jigs.

Various changes and modifications may be made within the scope of the inventive concept.

We claim:

1. Internal combustion engine ignition breaker assembly construction comprising a fixed carrier plate (10) and a breaker contact support plate (11) located axially adjacent the carrier plate (10) and pivotable with respect thereto about the central axis (19) of the assembly, a bearing sleeve (17) of elastic material fitted coaxially with said axis into central openings formed in both the carrier plate (10) and the support plate (11) and connecting said plates, said sleeve being inserted through the openings of said plates and including means to hold said plates together and forming a bearing for said support plate (11) and permitting rotation with respect to said carrier plate (10), said bearing sleeve (17) being formed with a first radial projection forming a flange (27) engaging the exposed surface of one of said plates and being further formed with a second axially extending projection including holding projections (30) extending radially therefrom and engaging over the exposed surface of the other of said plates (11), the sleeve (17) being formed with axially extending slits beginning at the holding projections (30) and terminating short of the flange (27) whereby the sleeve (17) will be subdivided into projecting tongues (28) throughout the portion of its axial length;

and a spring ring (33) located interiorly of said sleeve (17) in the region of said tongues (28) and exerting radially outwardly directed resilient force on said tongues to tend to press the tongues outwardly and hence the holding projections in overlapping engagement over the other of said plates (11).

2. Construction according to claim 1, wherein the bearing sleeve (17) is a unitary plastic injection-molded element.

3. Construction according to claim 1, further comprising axially acting resilient means (36) located between at least one of the projections and the respective plate.

4. Construction according to claim 1, further comprising an undulating leaf spring (36) interposed between the flange (27) and the carrier plate (10) to exert a resilient axial engagement force of the flange of the sleeve with respect to said plates and to resiliently connect the plates in face-to-face relationship.

5. Construction according to claim 4, wherein at least one of the plates is formed with a conically dilating opening, the sleeve (17) being formed with a matching conical outer surface, the leaf spring (36) providing axial force between the plates to seat the outer surface of the sleeve (17) within the conically dilating opening.

6. Construction according to claim 5, wherein the plate formed with the conically dilating opening is formed with a collar (22) concentrically surrounding the opening, the inner surface of the collar being formed with said conically dilating opening;

a groove (34) formed in the inner wall (35) of the sleeve (17) in the region of the tongues (28);

the spring ring (33) exerting radially outwardly directed force being snapped into said groove (34) to ensure overlap of said holding projections (30) over the collar (22).

7. Construction according to claim 1, wherein the inner surfaces (35) of the sleeve (17) in the region of the tongues (28) are formed with a groove (34), the spring ring (33) being seated in the groove.

8. Internal combustion engine ignition breaker assembly construction comprising a fixed carrier plate (10) and a breaker contact support plate (11) located axially adjacent the carrier plate (10) and pivotable with respect thereto about the central axis (19) of the assembly, a bearing sleeve (17) of elastic material fitted coaxially with said axis into central openings formed in both the carrier plate (10) and the support plate (11) and connecting said plates, said sleeve being inserted through the openings of said plates and including means to hold said plates together and forming a bearing for said support plate (11) and permitting rotation with respect to said carrier plate (10), said bearing sleeve (17) being formed with a first radial projection forming a flange (27) engaging the exposed surface of one of said plates and being further formed with a second axially extending projection including holding projections (30) extending radially therefrom and engaging over the exposed surface of the other of said plates (11), wherein at least one of the plates (11) is formed with a conically dilating opening;

the sleeve (17) has a partially conical outer surface matching the conically dilating opening; and means (36) are provided applying an axial force between the plates (10, 11) to seat the outer surface of the sleeve (17) in the conically dilating opening.

9. Construction according to claim 8, wherein the means applying an axial force comprises an undulating leaf spring (36) interposed between the flange (27) and the carrier plate (10) to exert a resilient axial engagement force of the flange of the sleeve with respect to said plates and to resiliently connect the plates in face-to-face relationship.

10. Construction according to claim 8, wherein the bearing sleeve (17) is a unitary plastic injection-molded element.

11. Internal combustion engine ignition breaker assembly construction comprising a fixed carrier plate (10) and a breaker contact support plate (11) located axially adjacent the carrier plate (10) and pivotable with respect thereto about the central axis (19) of the assembly, a bearing sleeve (17) of elastic material fitted coaxially with said axis into central openings formed in both the carrier plate (10) and the support plate (11) and connecting said plates, said sleeve being inserted through the openings of said plates and including means to hold said plates together and forming a bearing for said support plate (11) and permitting rotation with respect to said carrier plate, said bearing sleeve (17) being formed with a first radial projection forming a flange (27) engaging the exposed surface of one of said plates and being further formed with a second axially extending projection including holding projections (30) extending radially therefrom and engaging over the exposed surface of the other of said plates (11), the sleeve (17) being formed with axially extending slits beginning at the holding projections (30) and terminating short of the flange (27) whereby the sleeve (17) will be and an undulating leaf spring (36) interposed between the flange (27) and the carrier plate (10) to exert a resilient axial engagement force of the flange of the sleeve with respect to said plates and to resiliently connect the plates in face-to-face relationship.

12. Construction according to claim 11, wherein the bearing sleeve (17) is a unitary plastic injection-molded element.

13. Construction according to claim 11, further including means (33) resiliently engaging the tongues (28) to hold the tongues engaged over the exposed surface of the other of said plates (11).

* * * * *

UNITED STATES PATENT AND TRADEMARK OFFICE

CERTIFICATE OF CORRECTION

PATENT NO. : 4,078,161

DATED : March 7, 1978

INVENTOR(S) : Heinz HAUG et al.

It is certified that error appears in the above-identified patent and that said Letters Patent are hereby corrected as shown below:

Claim 11, col. 6, line 36, after "will be" add: --subdivided into projecting tongues (28) throughout the portion of its axial length--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*